United States Patent [19]

Coller

[11] 4,055,917

[45] Nov. 1, 1977

[54] DOOR AND THRESHHOLD ASSEMBLY

[75] Inventor: John Coller, Redondo Beach, Calif.

[73] Assignee: Elixir Industries, Gardena, Calif.

[21] Appl. No.: 621,830

[22] Filed: Oct. 14, 1975

[51] Int. Cl.[2] ..... E06B 1/70

[52] U.S. Cl. ..... 49/469

[58] Field of Search ..... 49/467–471, 49/479, 489, 498, 495; 52/309, 624, 629

[56] References Cited

U.S. PATENT DOCUMENTS

| | | | |
|---|---|---|---|
| 2,108,137 | 2/1938 | Oftedal | 49/471 |
| 2,167,958 | 8/1939 | Oftedal et al. | 49/471 X |
| 2,848,766 | 8/1958 | Fulton | 49/469 |
| 2,933,782 | 4/1960 | Correll | 49/469 |
| 2,949,651 | 8/1960 | Hill | 49/470 |
| 3,079,652 | 3/1963 | Wahlfeld | 49/469 |
| 3,310,920 | 3/1967 | Bell et al. | 49/467 X |
| 3,346,994 | 10/1967 | Kesler | 49/470 |
| 3,774,343 | 11/1973 | Cribben et al. | 49/467 |
| 3,851,420 | 12/1974 | Tibbetts | 49/471 |

*Primary Examiner*—Roy D. Frazier
*Assistant Examiner*—Terrell P. Lewis
*Attorney, Agent, or Firm*—Gausewitz, Carr & Rothenberg

[57] ABSTRACT

An inwardly swinging door is provided with a threshhold assembly that effectively seals against entry of driven water and air. The threshhold assembly includes a sloping subpan having an upstanding rear wall. An integral outer threshhold member and upper pan are connected to and above the subpan. The upper pan provides a primary seal at the front edge of the door bottom and defines a primary sill floor that cooperates with the flexible wiper blades carried by the door bottom to define secondary barriers. The inner side of the door bottom carries a final seal which bars entry of air that may be driven through drainage holes provided in the subpan and interconnecting the interior of the subpan with the interior of the upper pan.

18 Claims, 8 Drawing Figures

FIG. 1.
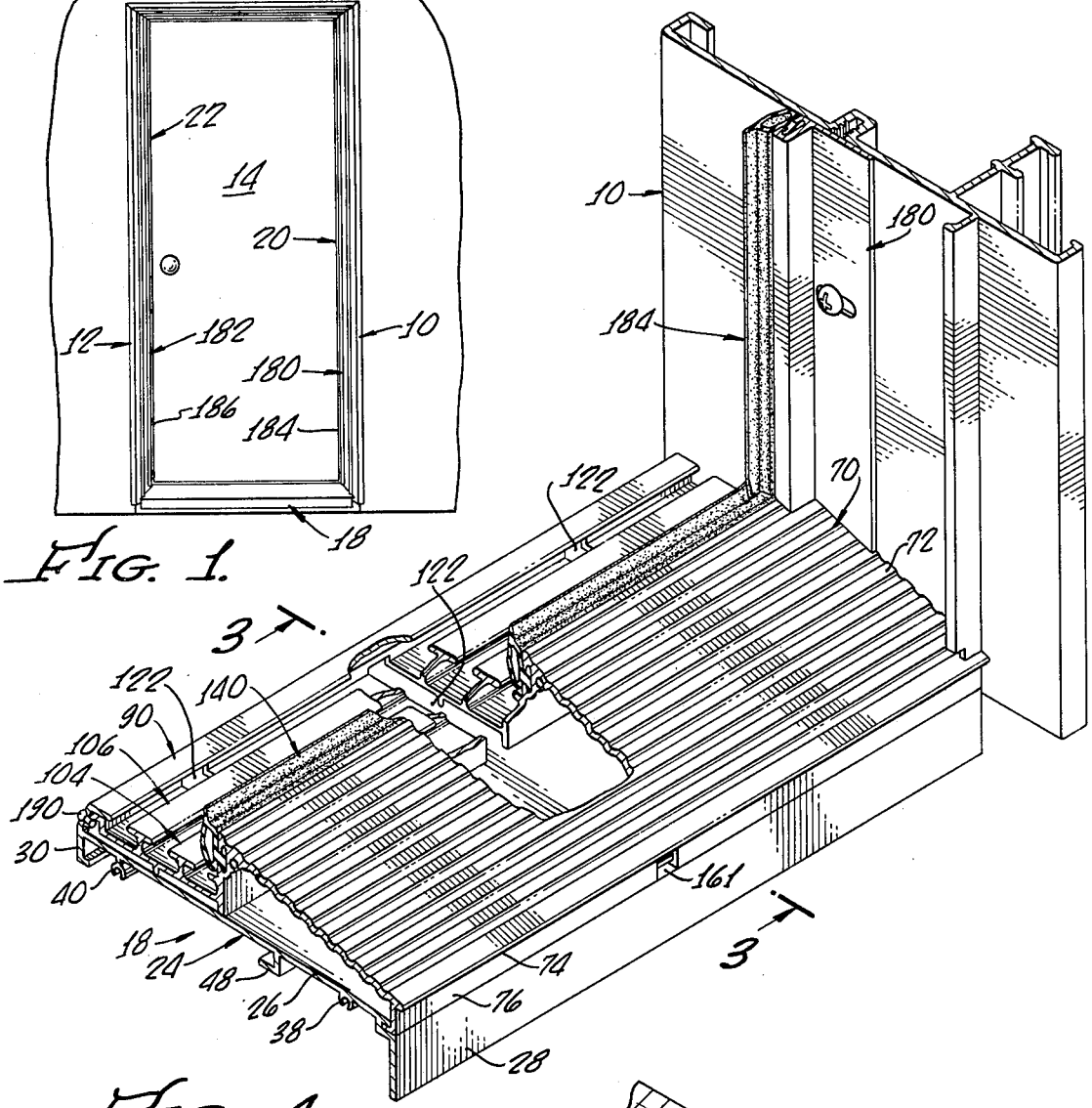
FIG. 4.
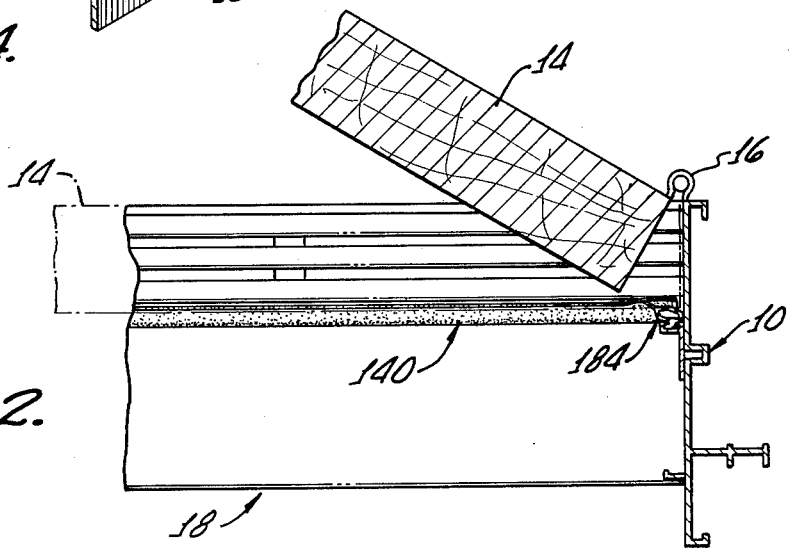
FIG. 2.

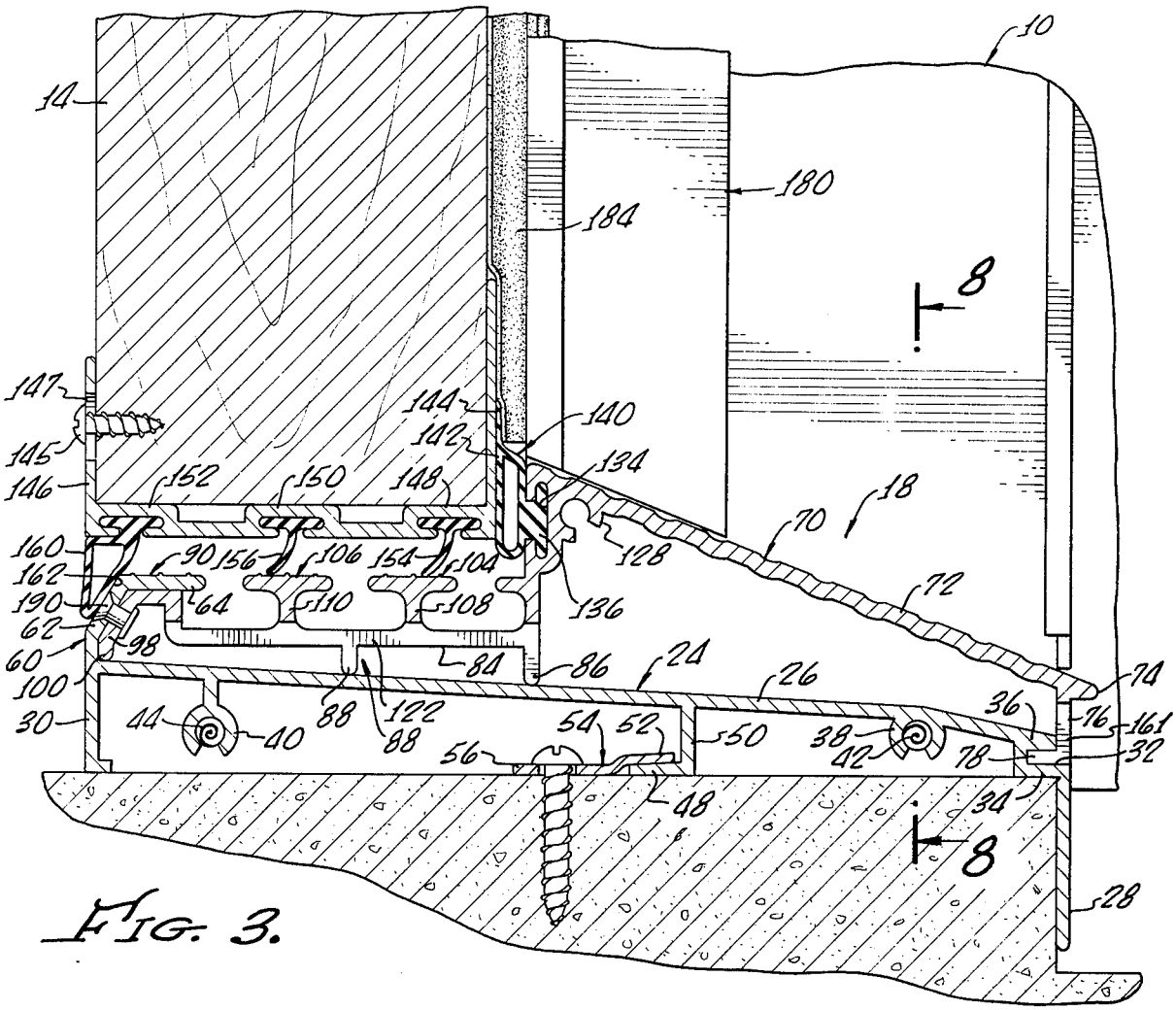
FIG. 3.
FIG. 7.
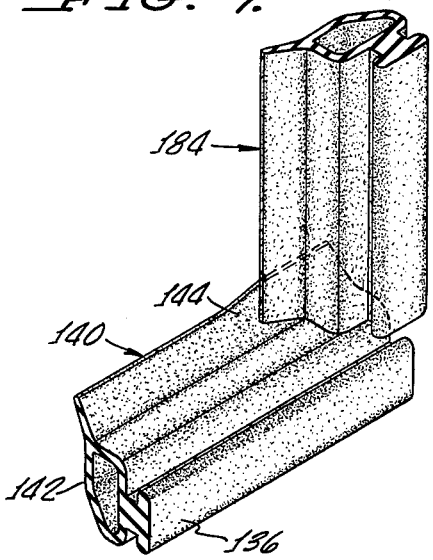
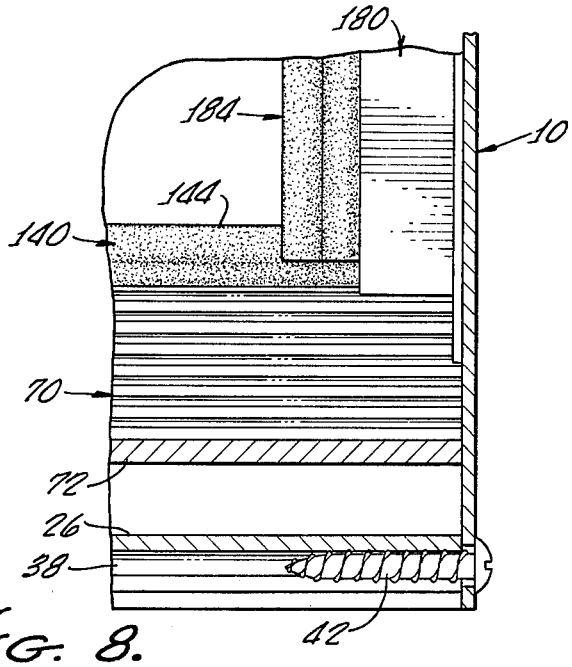
FIG. 8.

DOOR AND THRESHHOLD ASSEMBLY

Background of the Invention

The present invention relates to door threshholds and more particularly concerns a threshhold assembly having improved water and wind sealing.

The construction of door frames and threshholds presents significant problems in the sealing of a door to prevent entry of water and wind under the door and in maintaining an effective seal between the threshhold and the door jambs. These problems are even more pronounced in inwardly swinging doors where at least that portion of a threshhold which is beneath the door when the latter is closed can have no parts extending above the plane of motion of the door bottom. In such inwardly swinging doors, despite many attempts at seal design, it is found that a seal solely at the front of the door fails to provide an effective barrier to entry of water and thus water will leak past such a front seal under various conditions.

Attempts have been made in the past to collect such water that somehow leaks past the front seal and to subsequently drain it from the threshhold. Such an arrangement is shown in the patents to Oftedal et al, U.S. Pat. Nos. 2,108,137 and 2,167,958. However, the constructions shown in these patents suffer from many disadvantages. A special configuration of door bottom is required with a depending lip to provide a forward seal. Collection of leaking water is afforded only for a relatively small portion of the available area and thus the device of the Oftedal et al patents will not tolerate high leakage rates. By virtue of use of a hollow extrusion for the threshhold assembly, the arrangements of these patents magnify a second major problem in the sealing of threshholds. This problem is the difficulty of caulking the joint between the ends of the sill and the door jambs. Water leaking through a door bottom has a tendency to collect at the ends of the sill near the jamb. Unless the joint between the jambs and the sill is properly and effectively caulked, a significant amount of leakage can occur at this point. In the use of a hollow extrusion for the threshhold, particularly one in which water will be collected on both upper and lower surfaces thereof, an effective seal of the threshhold to the door jamb is exceedingly difficult, if not impossible. Where a threshhold assembly has both upper and lower elements, both extending the length of the threshhold, it may be possible to caulk the joint of the upper member to the jamb, but the caulking of the joint between the lower member and the jamb may not be feasible.

Where means is provided, as in the Oftedal et al patents, to collect water that has leaked past the forward seal, such water collection area is completely exposed when the door is open and may provide an esthetically displeasing sight, since much dirt and moisture are collected here.

Accordingly, it is an object of the present invention to provide an improved door threshhold assembly that effectively seals against water and air and yet avoids or minimizes the above-mentioned problems.

Summary of the Invention

In carrying out principles of the present invention in accordance with a preferred embodiment thereof, an elongated subpan is connected to and supports a separate elongated tread member that is positioned above the subpan. According to one feature of the invention, the tread member is connected to the subpan at the front and back of the threshhold assembly whereby the subpan may be effectively caulked to the jambs before attachment of the upper tread member.

According to another feature of the invention, the tread member includes an integral upper pan which is spaced above a rear portion of the subpan and has a width substantially equal to the full thickness of the door. A primary seal is provided between the front of the door bottom and the front of the upper pan. Secondary seals are provided by a number of barriers upstanding from the upper pan and collectively defining a primary sill floor that drains to the upper pan which, in turn, drains to the subpan.

According to other features of the invention, the door carriers wipers that cooperate with the upstanding barrier means and sill floor to provide secondary water barriers and a final seal is provided between the rear edge of the threshhold assembly and the bottom of the door to block air that may flow through the drainage ports of the subpan and upper pan. The subpan carries a depending hook which engages one or more clips fixed to the bottom of the doorway so that the assembly may be secured in place without any fastening elements extending through the assembly and thus points of additional possible leakage are avoided.

BRIEF DESCRIPTION OF THE DRAWINGS

FIG. 1 illustrates a door and door frame assembly having a threshhold assembly of the present invention mounted herein;

FIG. 2 is a fragmentary sectional view of the structure of FIG. 1;

FIG. 3 is a sectional view of the threshhold assembly taken on lines 3—3 of FIG. 4 showing its relation to the bottom of the door;

FIG. 4 is a perspective view, with parts broken away, showing a fragment of threshhold assembly and jamb;

FIGS. 7 and 8 illustrate details of the seal at the front of the door bottom and its cooperation with the seal on the door jamb, FIG. 8 being taken on lines 8—8 of FIG. 3.

DETAILED DESCRIPTION

Figure 6:
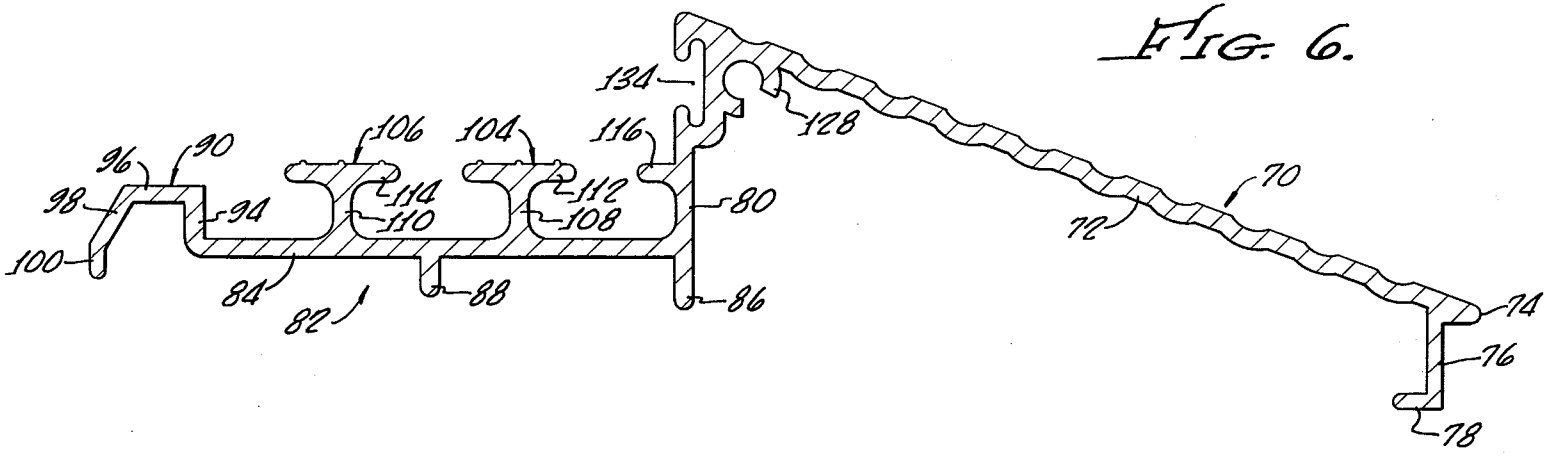
FIG. 6 is an enlarged sectional view of the tread member extrusion.

As illustrated in FIGS. 1 and 2, doorway defined by first and second door jambs 10, 12 carries a door 14 which is hinged as at 16 to jamb 10 to swing between an inwardly open position and a closed position in which it extends across the entire width of the doorway. In closed position, the bottom of the door 14 is positioned in sealing relation with respect to a threshhold assembly 18 and its vertical edges are sealed to the jambs 10 and 12 by sealing means 20 and 22, respectively. As best shown in FIGS. 3 and 4, the threshhold assembly is formed of two separate but interconnected elements. Preferably each of these is formed as an integral extrusion of a suitable waterproof and weather resistant metal, such as aluminum. The first extrusion comprises a subpan 24 which is shown in enlarged detail in FIG. 5. The extrusion has a uniform cross-section throughout its length which comprises an extrusion or subpan bottom 26 extending the full width of the subpan from a forward or outer downwardly projecting support leg 28 to a rear or inner downwardly projecting support leg 30. At the forward edge of the elongated subpan 24, at the junction between the bottom 26 and forward support leg 28, a forwardly opening elongated slot 32 is formed between a rebated portion 34 of leg 28 and a forwardly projecting edge 36 of the bottom 26.

Tubular segments 38, 40 are integrally formed to and project downwardly from the underside of subpan bottom 26 to receive screws 42, 44 (FIG. 3) that extend through apertures at the bottom of each of the door jambs into threaded engagement with the interior of the tubular segments 38, 40 to thereby fixedly secure the ends of the subpan to the bottoms of the jambs.

A continuous hook 46 comprises a rearwardly projecting leg 48 fixed to the lower end of a downwardly projecting support leg 50. The hook is integrally formed along the length of and as part of the extrusion 24 for fixing the subpan to the bottom of the doorway. Hook 46 is adapted to be slid under the raised forwardly porjecting flanges 52 of a number of clips 54 (FIG. 3), each having an integral plate 56 that is screwed or otherwised fixedly connected to the bottom of the doorway. Thus, the leg or arm 48 which is slightly tapered to provide a camming engagement with the flange 52 may be slid under the flange 52 causing the tapered upper surface of arm 48 to tightly draw the subpan down toward the bottom of the doorway and hold the subpan in position without any fastening element extending through the subpan bottom.

Figure 5:
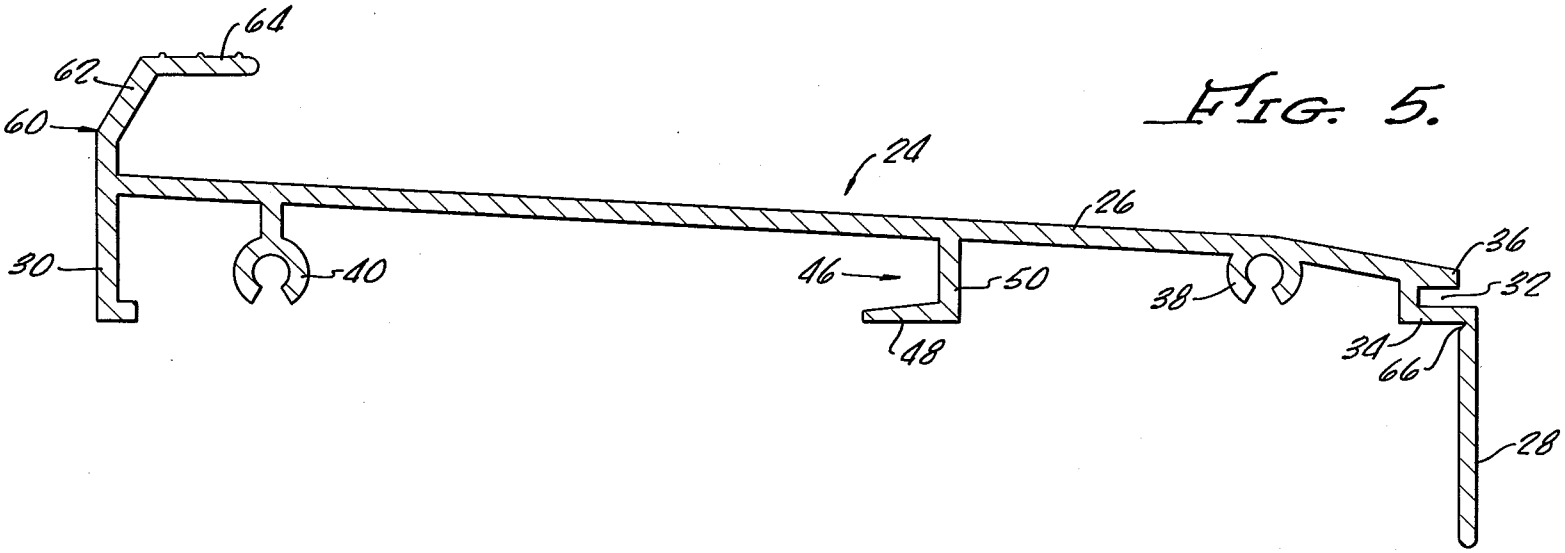
FIG. 5 is an enlarged sectional view of the subpan extrusion.

At the rear of the subpan there is provided an upstanding wall 60 having a forwardly sloping section 62 that terminates in a substantially horizontally positioned and forwardly projecting section 64. When mounted in the doorway as shown in FIG. 3, the support legs 28 and 30 are secured to the bottom of the doorway. Alternatively, where the construction of the doorway bottom so requires, the front support leg 28 may be broken off from the front of the subpan along a longitudinally extending notch 66 whereby the front of the subpan will be supported by the forwardly projecting flange 34. Nevertheless, when mounted and whether supported by the flange 34 or the leg 28, the bottom of the subpan for a major portion of its width, namely, between the rear portion thereof and the tubular segment 38 is substantially flat, continuous and free of any upwardly extending obstructions to facilitate sealing to the jambs. Further, when mounted, the bottom slopes outwardly and downwardly at an angle of approximately3° below the horizontal to provide for free and unobstructed flow of water drained from the upper pan as will be described hereinafter. At the tubular segment 38, the bottom 26 increases its downward and forward slope as indicated in FIGS. 3 and 5. This enhances drainage from the front of the subpan, as will be described below.

The second part of the threshhold assembly is formed by a second integral threshhold extrusion 70 which is shown in enlarged detail in FIG. 6. Extrusion 70 includes a forward section comprising a downwardly and forwardly sloping threshhold or tread member 72 terminating at a forward edge 74 and carrying a downwardly projecting forward leg 76 adjacent the forward edge 74. Leg 76 carries at its lower end a substantially horizontal and rearwardly projecting tongue 78 that extends into the slot 32 of subpan 24 when the threshhold extrusion is assembled to and upon the subpan extrusion. At the rear of the tread member 72, a substantially vertical wall 80 is provided that forms both the rear wall of the tread member and a forward wall of the integral upper pan 82. Upper pan 82 includes a bottom 84 having elongated transversely spaced downwardly extending ribs 86, 88 which bear at their ends upon the upper surface of subpan bottom 26 to assist in supporting the threshhold extrusion upon the subpan.

The upper pan includes a rear lip 90 having a rear wall section 94, a substantially horizontal wall section 96 and a downwardly and rearwardly sloping wall section 98 terminating in a substantially vertical edge 100. Lip 90 is adapted to be received within the subpan recess formed by pan bottom 26 and rear wall sections 62 and 64, with sections 96 and 64 in close mutual engagement and sections 98 and 62 also in close mutual engagement, as illustrated in FIG. 3. Edge 100 of the upper pan rests upon the upper surface of subpan bottom 26 to provide a rear support for the upper pan. Upstanding from the upper pan bottom 84 and extending the full length of the extrusion, as do all of the other elements of both extrusions, are first and second T-shaped barrier members 104, 106 having support legs 108, 110 and substantially horizontally extending arms 112, 114. Arms 112 and 114 are mutually spaced from each other and from the front and rear edges of the upper pan across the width of the upper pan. Also extending horizontally from the front wall and projecting rearwardly from the front wall 80 of the upper pan is a ledge 116 which is spaced from an adjoining edge of arm 112. Ledge 116 and wall section 64 of the subpan both have their upper surfaces lying in the plane of upper surfaces of barrier elements 104, 106. Ledge 116 together with the barrier arms 112, 114 and wall section 64 of the subpan thus collectively define a slotted primary sill floor which drains to the bottom 84 of the upper pan 82. Drainage from the sill floor to the bottom 84 is provided by the longitudinally extending slots formed between adjacent edges of ledge 116, section 64 and arms 112 and 114. Drainage from the upper pan to the subpan is provided by longitudinally spaced drainage apertures or slots 122 formed in the upper pan bottom 84, in the bottoms of barrier legs 108, 110, and in the bottom of upper pan ribs 86 and 88.

A tubular segment 128 is formed on the underside of the rear portion of tread member 72 for reception of screws extending through the side of the jamb into threaded engagement with the tubular segment. This may be used in some situations to assist in securing the upper extrusion or tread extrusion in place. However, where the upper extrusion is to be removed at some later time (as for re-caulking at the jambs), it is not connected to the jambs, but just to the lower extrusion, as described below.

Also formed in the wall 80 at an upper portion thereof is a rearwardly facing T-shaped slot 134 that receives a T-shaped connector 136 (Fig. 3) integrally formed on a forward or primary seal 140. Seal 140 (FIGS. 7 and 8) is formed with a vertically elongated (in cross-section) hollow body 142 having an upstanding fin 144 extending the length of the seal for a purpose to be more particularly hereinafter.

As seen in FIG. 3, the bottom of the door carries an upwardly open channel 146 having a plurality of downwardly opening T-shaped slots 148, 150, 152 of which slots 148 and 150 carry a pair of flexible wiper blades 154, 156. Slot 152 carries a hollow final seal 160 having a forwardly facing sloping face 162 that bears against the rearwardly facing surface of rear wall section 62 of the subpan 24 when the door is in closed position. This final seal 160 blocks flow of air which may otherwise pass from the outside of the threshhold assembly through a plurality of spaced drainage apertures 161 in the front wall or leg 76 of the threshhold extrusion, and through the elongated drainage apertures 122 between the subpan and upper pan. Channel 146 is preferably vertically adjustable on the bottom of the door as by screws 145, extending into the door through vertically elongated slots 147 formed in at least one side of the channel.

Mounted upon each door jamb and adjustable forwardly and rearwardly of the doorway are substantially L-shaped elongated seal carrying members 180, 182 in which are mounted elongated seals 184, 186 which are of identical construction to seals 142. As best shown in FIGS. 7 and 8, the bottom of seals 184 and 186 extend down to engagement with the upper edge of the body 142 at respective ends of primary seal 140 so that the upstanding fin 144 of the latter will overlap the lower end of each of the jamb seals 184 and 186. This overlapping arrangement not only provides a good tight seal at the ends of the threshhold adjacent the jamb but is so arranged that when the door is in closed position as shown in FIGS. 3 and 8, the door will press against the forwardly facing surface of upstanding fin 144 to thereby press this fin in its overlapping relation against the bottom end of jamb seals 184, 186 and thereby enhance the tightness of the sealing engagement between the seals. Members 180 and 182 are mutually identical, but of mutually opposite hand, and seals 184, 186 are mutually identical and of mutually opposite hand so that the corner seals at the two jambs are the same.

In installation of the described threshhold the two jambs are secured to the subpan and this assembly is installed in the doorway after the clips 54 are fixed to the bottom of the doorway. The subpan assembly is positioned at the bottom of the doorway with its depending hook 46 tightly engaged under the forward flange 52. This tightly and fixedly secures the subpan to the doorway without forming any holes in the subpan for its securement. The jambs 10 and 12 are screwed or otherwise secured to the sides of the doorway. As can be seen in the drawings, the edges of the subpan at their junction thereof with the jambs, have the upper sides thereof continuous, extending in an unbroken line completely free of any obstructions or connections with other elements. Thus, the caulking of this upper surface of the end edges of the subpan to the jambs may be readily achieved (before installing the upper or threshhold extrusion). If there were upstanding members fixed to the subpan floor and further, if caulking must be achieved after installation or securement of the threshold extrusion, the caulking of the subpan floor to the jambs would be difficult, if not impossible.

After caulking of the subpan to the jambs, the threshhold extrusion is fixed to and upon the subpan. The rear lip of the upper pan is inserted into the recess formed by the rear wall of the subpan and at the same time the rearwardly projecting tongue 78 at the forward edge of the threshhold member is inserted into the forwardly facing slot 32. Now, the upper extrusion is snugly mounted upon and engaged within and supported upon the subpan assembly. Fastening means such as screws or rivets 190 (FIGS. 3, 4) are then inserted through preformed apertures in upper portions of the rear wall sections 62 and 98 of the subpan and upper pan to thereby more firmly secure these members to each other. It will be understood that these fastening means, whether screws or rivets or the like can be readily removed to enable removal of the upper extrusion if recaulking of the subpan to the jambs should become necessary. Thus, not only is the subpan formed with a configuration that facilitates a most effective caulking to the jamb but the threshhold assembly is arranged so that re-caulking can be readily achieved upon removal of the upper extrusion.

In operation of the threshhold assembly the primary seal 140 provides a first barrier against entry of water to the bottom of the door. Water may pass this seal under heavy pressure, as in a strong wind-driven rain, for example. Such water then must pass the additional secondary barriers formed between barrier elements 104, 106 and the wipers 154, 156. Water stopped by these wipers will flow from the primary sill floor to the bottom 84 of the upper pan and thence drain from the upper pan through drain slots 122 down to the bottom 26 of the subpan. Because this bottom slopes downwardly and forwardly, water will flow along the subpan forwardly out of the threshhold through the apertures 161 in the forward leg 76 of the tread member.

Water that may get past the secondary seals of the wipers 154, 156 will tend to collect in the upper pan under particularly severe conditions of wind-driven water. Thus the upper pan, under extreme conditions may contain water to a level of the horizontally extending arms of the barriers 104, 106. Water at this level provides a pressure or head of water that further assists in causing the water that has leaked past the primary and secondary barriers to flow from the upper pan to the subpan and then from the subpan forwardly out of the threshhold.

The final seal 160, at the rear of the door bottom, also provides a final barrier against leaking water that tends to be driven under the door past the threshhold, and thus completes the water sealing arrangement. This final seal 160, as previously mentioned, also provides an air seal to block passage of air which may blow through the subpan and upper pan drain apertures to the bottom of the door.

The upper pan which forms the primary sill floor and the primary water collection trough has a maximized volume by virtue of the described arrangement in which the width of this upper pan is substantially equal to the width of the door. This arrangement of the wide upper pan not only provides an increased volume of drainage collection but also enables the use of the primary seal 140 at its most effective point, which is at the front of the door bottom.

An advantage of the barriers 104, 106, in additional to their functioning as a secondary water leakage barrier, derives from the fact that they are positioned to cooperate with the moving wipers 154, 156 which swing with the door as the latter moves on its hinges. Thus, the barriers are wiped clean by the blades 154, 156 whenever the door closes, thereby sweeping water collected on the surfaces of barriers 104, 106 down to the bottom of the upper pan. Still further, by providing a primary sill floor above the bottom of the upper pan wherein leaked water is collected, the barriers, flange 116 and wall section 64 provide an improved esthetic appearance. Dirt and water collected and contained in the upper pan are substantially hidden from view, being visible only through the relatively narrow slots that extend longitudinally between adjacent ones of elements 116, 112, 114 and 64.

The arrangement provides a water barrier which resists differential pressures across the door to the extent of the height of the rear wall of the subpan with respect to the height of the forward edges of the subpan. This head, in addition to the other features described above, resists outside pressures which tend to drive water over the threshhold to the interior.

There has been described an improved threshhold assembly which greatly facilitates effective caulking and re-caulking, provides effective multi-element sealing at the bottom of the door and at the door jambs, provides for drainage of water that leaks through outer seals and provides a seal against flow of air throught the drainage path.

The foregoing detailed description is to be clearly understood as given by way of illustration and example only, the spirit and scope of this invention being limited solely by the appended claims.

What is claimed is:

1. For use with a door hinged in a doorway, a threshhold assembly comprising an elongated subpan adapted to be mounted in said doorway and to extend across the doorway, said subpan including means for effecting drainage therefrom, an elongated threshhold member mounted to said subpan and positioned above a forward portion thereof, an elongated upper pan mounted to said subpan and spaced above said subpan, said upper pan extending along the length of said subpan and across the width of said subpan from a rear edge thereof to a rear edge of said threshhold member, said upper pan having a width substantially equal to the thickness of said door, drainage means interconnecting said subpan and upper pan, a door jamb upstanding at a side of said doorway, a first flexible elongated sealing strip fixed to and extending along said jamb, a second flexible elongated sealing strip fixed to and extending along the rear edge of said threshhold member, said second sealing strip having an elongated upstanding fin that overlaps said first sealing strip at adjacent ends of said strips, one of said sealing strips adapted to be engaged by said door to thereby be pressed against the other of said sealing strips at said jamb and provide a tightly sealed corner at the bottom of said jamb.

2. For use with a door hinged in a doorway, a threshhold assembly comprising an elongated subpan adapted to be mounted in said doorway and to extend across the doorway, said subpan including means for effecting drainage therefrom, an elongated threshhold member mounted to said subpan and positioned above a forward portion thereof, an elongated upper pan mounted to said subpan and spaced above said subpan, said upper pan extending along the length of said subpan and across the width of said subpan from a rear edge thereof to a rear edge of said threshhold member, said upper pan including a drainage collection volume having a width substantially equal to the thickness of said door, drainage means interconnecting said subpan and upper pan, means for sealing the front of said door against a rear edge of said threshhold member, and means for sealing an inner edge of the door against the rear edge of said threshhold assembly to block air flow through drainage paths of said threshhold assembly.

3. For use with a door hinged in a doorway, a threshhold assembly comprising an elongated subpan adapted to be mounted in said doorway and to extend across the doorway, said subpan including means for effecting drainage therefrom, an elongated threshhold member mounted to said subpan and positioned above a forward portion thereof, an elongated upper pan mounted to said subpan and spaced above said subpan, said upper pan extending along the length of said subpan and across the width of said subpan from a rear edge thereof to a rear edge of said threshhold member, said upper pan having a width substantially equal to the thickness of said door, drainage means interconnecting said subpan and upper pan, said upper pan being spaced below the bottom of the door and including barrier means upstanding from said upper pan for defining a primary sill floor between the bottom of said door and said upper pan, said sill floor including means for providing drainage therefrom to said upper pan.

4. The combination of claim 3 including flexible wiper means carried by the bottom of said door and extending into engagement with said barrier means when said door is closed to thereby wipe and seal said sill floor upon closing of said door.

5. The combination of claim 4 wherein said barrier means includes a plurality of drain openings in said sill floor, said drain openings being mutually spaced from front to back of said upper pan and extending along the length of said doorway.

6. The combination of claim 4 wherein said barrier means comprises means for defining a longitudinally slotted sill floor having a plurality of slots spaced from each other across the width of said upper pan.

7. The combination of claim 4 wherein said barrier means comprises a plurality of elongated barrier elements each having a supporting leg fixed to said upper pan and a sill floor defining surface at an upper portion of said leg and extending substantially at right angles thereto, said wiper means comprising a plurality of flexible wiper elements secured to and depending from the bottom of said door, each said wiper element cooperating individually with a respective one of said barrier elements to form a plurality of seals extending the length of said threshold assembly in mutually spaced positions across the width of said upper pan.

8. The combination of claim 7 wherein said threshold member, upper pan and barrier means are formed integrally with one another, and wherein said subpan is formed as an integral part having a clear and unobstructed end to facilitate caulking of said subpan to a door jamb prior to connecting said threshold, upper pan and barrier means to said subpan.

9. The combination of claim 8 including clip means adapted to be connected to the bottom of a doorway and hook means fixed to and depending from said subpan for slidably engaging said clip means to lock said subpan to said clip means.

10. The combination of claim 7 including a vertically adjustable wiper support adjustably carried by the bottom of said door, said wipers being mounted in said wiper support.

11. A threshhold assembly for use with a door comprising an elongated subpan having an inner section extending under said door, a separate elongated tread member positioned above said subpan and including an upper pan coextensive with said subpan inner section under said door, means for detachably connecting said tread member and upper pan to and supporting it from said subpan, said subpan including an upstanding rear wall, said means for connecting comprising first fastening means for interconnecting the front of said subpan to the front of said tread member, second fastening means for interconnecting the rear wall of said subpan to the rear of said tread member, said second fastening means comprising a rear wall on said tread member engaging said rear wall of said subpan, and means for connecting said rear walls to each other.

12. A threshhold assembly for use with a door comprising an elongated subpan having an inner section extending under said door, a separate elongated thread member positioned above said subpan and including an upper pan coextensive with said subpan inner section under said door, means for detachably connecting said tread member and upper pan to and supporting it from said subpan, said subpan including an upstanding rear wall, said means for connecting comprising first fastening means for interconnecting the front of said subpan to the front of said tread member, second fastening means for interconnecting the rear wall of said subpan to the rear of said tread member, said first fastening means comprising a forwardly facing slot formed at the front of said subpan, and a rearwardly projecting tongue received in said slot and fixed to the front of said tread member.

13. A threshhold assembly comprising an elongated subpan a separate elongated thread member positioned above said subpan, means for connecting said tread member to and supporting it from said subpan comprising first fastening means for interconnecting the front of said subpan to the front of said tread member and second fastening means for interconnecting the rear wall of said subpan to the rear of said tread member, said subpan including an upstanding rear wall, said second fastening means comprising a flange fixed to and projecting forwardly from an upper portion of said rear wall of said subpan, a lip fixed to the rear of said tread member, said lip having sections engaging both the bottom of said flange and the forward side of said rear wall, and means for connecting said lip to said subpan.

14. A threshhold assembly comprising an elongated subpan, a separate elongated tread member positioned above said subpan, means for connecting said tread member to and supporting it from said subpan, said tread member including a threshhold section extending along and above a forward portion of said subpan, an upper pan section extending along and above a rearward portion of said subpan, means for draining said upper pan section into said subpan, said upper pan section including an upper pan bottom and a plurality of elongated barrier means for defining a sill floor above said upper pan bottom and for providing drainage from said sill floor to said upper pan bottom.

15. The assembly of claim 14 wherein said barrier means comprise a plurality of elongated barrier elements each having a T-shaped cross-section, said barrier elements having substantially vertical legs fixed to said upper pan bottom and having substantially horizontally extending arms spaced from one another across the width of said upper pan section.

16. The assembly of claim 14 including hook means integrally formed with and projecting downwardly from said bottom element, said hook means including means for connection to the bottom of a doorway, said subpan being free of fastening elements extending through said bottom element.

17. A door assembly comprising a pair of spaced door jambs defining a doorway therebetween, a door hinged to one of said jambs, a threshhold assembly comprising a subpan extending the length of said doorway and sloping outwardly and downwardly thereof, an upper arm connected with said subpan and spaced above said subpan, said upper pan extending the length of said doorway and having a width substantially equal to the width of said door, means for providing drainage from said upper pan to said subpan, means for sealing a front edge of the bottom of said door against said upper pan, means for sealing the rear edge of the bottom of said door against the rear portion of said threshhold assembly, at least one barrier element upstanding from said upper pan and having a sill floor defining strip spaced from both front and back of said upper pan, a flexible wiper element carried by the bottom of said door for flexibly engaging the upper portion of said barrier element, said subpan including an upstanding rear wall extending along and over a rear portion of said upper pan, said door including a flexible sealing strip secured to the rear edge of the bottom thereof for engaging said rear wall of said subpan to seal the rear of said door.

18. The apparatus of claim 17 wherein said upper pan includes a downwardly and outwardly extending threshhold element, said threshhold element having a rear wall in sealing engagement with the front edge of said door when the latter is closed and having a front wall interengaged with a forward portion of said subpan for connection of said threshhold element and subpan.

* * * * *

UNITED STATES PATENT AND TRADEMARK OFFICE

CERTIFICATE OF CORRECTION

PATENT NO. : 4,055,917

DATED : November 1, 1977

INVENTOR(S) : John Coller

It is certified that error appears in the above-identified patent and that said Letters Patent are hereby corrected as shown below:

Col. 2, line 31: Change "herein" to ---therein---;

Col. 2, line 48: After "2," insert ---a---;

Col. 3, line 18: Change "porjecting" to ---projecting---;

Col. 6, line 49: Change "additional" to ---addition---;

Col. 7, line 10: Change "thought" to ---through---;

Col. 10, line 35: Change "arm" to ---pan---.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*